US007650648B2

(12) United States Patent
Roberts

(10) Patent No.: US 7,650,648 B2
(45) Date of Patent: Jan. 26, 2010

(54) IMPACT-DISPERSING PROTECTIVE UNDERGARMENTS

(75) Inventor: Ronald L Roberts, Toledo, OH (US)

(73) Assignee: Thundawear, L.L.C., Toledo, OH (US)

( * ) Notice: Subject to any disclaimer, the term of this patent is extended or adjusted under 35 U.S.C. 154(b) by 0 days.

(21) Appl. No.: 12/138,041

(22) Filed: Jun. 12, 2008

(65) Prior Publication Data

US 2008/0307569 A1 Dec. 18, 2008

Related U.S. Application Data

(60) Provisional application No. 60/943,980, filed on Jun. 14, 2007.

(51) Int. Cl.
*A42B 3/22* (2006.01)
*A42B 3/00* (2006.01)

(52) U.S. Cl. ..... 2/195.8; 2/455; 2/411; 2/200.1

(58) Field of Classification Search ..... 2/228, 2/227, 238, 69, 67, 400–408, 455, 456, 466, 2/79, 267, 268, 410–413, 202, 205, 200.1, 2/198.5, 171, 6.6; 450/97–99, 100–104
See application file for complete search history.

(56) References Cited

U.S. PATENT DOCUMENTS 4,035,844 A * 7/1977 Atack et al. ..... 2/466
4,091,466 A * 5/1978 Kearn ..... 2/23
4,945,571 A * 8/1990 Calvert ..... 2/467
5,052,052 A * 10/1991 Gilford et al. ..... 2/467
5,054,127 A * 10/1991 Zevchak ..... 2/247
5,134,726 A * 8/1992 Ross ..... 2/465
5,152,301 A 10/1992 Kittelsen et al.
5,712,011 A 1/1998 McMahon et al.
5,826,273 A * 10/1998 Eckes ..... 2/69
6,182,297 B1 2/2001 Duren et al.
6,289,522 B1 9/2001 Jones et al.
6,485,446 B1 * 11/2002 Brother et al. ..... 602/20
6,493,881 B1 12/2002 Picotte
6,845,446 B1 * 1/2005 Fuller ..... 713/153
2004/0255356 A1 12/2004 Lesosky
2005/0066404 A1 3/2005 Barker
2005/0102726 A1 5/2005 Gold et al.
2005/0114985 A1 6/2005 Falone et al.
2005/0177929 A1 8/2005 Greenwald et al.
2006/0154566 A1 7/2006 Nunez et al.
2006/0277647 A1 12/2006 Dobkin
2007/0077860 A1 4/2007 Brooks

* cited by examiner

*Primary Examiner*—Gloria Hale
(74) *Attorney, Agent, or Firm*—Fraser Clemens Martin & Miller LLC; J. Douglas Miller

(57) ABSTRACT

An impact-dispersing undergarment is provided. The impact-dispersing undergarment includes a wearable substrate, such as a flexible fabric, adapted to cover at least a portion of an individual's body. The undergarment includes at least one resilient, impact-dispersing gel packet coupled to the wearable substrate. The gel packets are selectively coupled to the wearable substrate and adapted for use underneath conventional protective padding. A method for protecting an individual during impact by employing the impact-dispersing undergarment under conventional protective padding is also provided.

2 Claims, 2 Drawing Sheets

IMPACT-DISPERSING PROTECTIVE UNDERGARMENTS

CROSS-REFERENCE TO RELATED APPLICATIONS

This application claims the benefit of U.S. Provisional Application No. 60/943,980, filed on Jun. 14, 2007. The entire disclosure of the above application is hereby incorporated herein by reference.

FIELD OF THE INVENTION

The present disclosure relates to protective garments and more particularly to impact-dispersing protective undergarments having gel inserts.

BACKGROUND OF THE INVENTION

When an individual participates in contact sports activities such as football, lacrosse, hockey, and the like, it is common that parts of the individual's body are subject to impact and other physical contact. Various attempts have been made to provide padding as a means of protecting the individual during such activities. Conventional protective equipment can include, as nonlimiting examples, helmets, shoulder pads, thigh pads, and shin pads, each of which generally employs padding. Typical protective equipment may include reinforced-sponge type padding, such as a rubber sponge layer laminated with a stiff plastic layer. The primary purpose of such padding is to provide a sufficiently thick layer of cushioning material and mitigate a force of an impact on the individual.

Conventional protective equipment typically forms a barrier to direct impact, but does not sufficiently dissipate the impact energy. As a consequence, protective equipment known in the art has only a marginal effect on the reduction of impact injuries such as concussions, contusions, and the like.

There is a continuing need for a means to reduce the effect of an impact on individuals using conventional padding during athletic and other physical activities. Desirably, the means include supplemental protective undergarment that militates against impact injuries such as concussions, contusions and the like.

SUMMARY OF THE INVENTION

In concordance with the instant disclosure, a supplemental protective undergarment that militates against impact injuries such as concussions, contusions, and the like, is surprisingly discovered.

In one embodiment, an impact-dispersing undergarment is provided. The impact-dispersing undergarment includes a plurality of resilient, impact-dispersing gel packets selectively coupled to a wearable substrate and adapted for use underneath conventional protective padding.

In another embodiment, an impact-dispersing skull cap includes a flexible fabric formed from a fine knit material and shaped to form fit to the head of an individual. The flexible fabric has a plurality of pockets. The skull cap includes fastening means for selectively holding the pockets closed. A plurality of resilient, impact-dispersing gel packets is selectively insertable into the pockets of the flexible fabric. The gel packets are formed from a resilient gel elastomer disposed within a viscoelastic outer shell. The gel packets are disposed on the skull cap to disperse and absorb at least a portion of an impact thereto.

In a further embodiment, a method for protecting an individual includes the steps of providing a wearable substrate adapted to receive a plurality of resilient, impact-dispersing gel packets; selectively coupling the plurality of gel packets to the wearable substrate to form an impact-dispersing undergarment, the placement adapted to provide supplemental protection underneath conventional protective equipment; disposing the impact-dispersing undergarment on the individual; and placing the protective equipment over the impact dispersing undergarment. The impact-dispersing undergarment thereby militates against injury to the individual resulting from an impact.

DRAWINGS

The above, as well as other advantages of the present disclosure, will become readily apparent to those skilled in the art from the following detailed description, particularly when considered in the light of the drawings described hereafter.

DETAILED DESCRIPTION OF THE INVENTION

Figure 1:
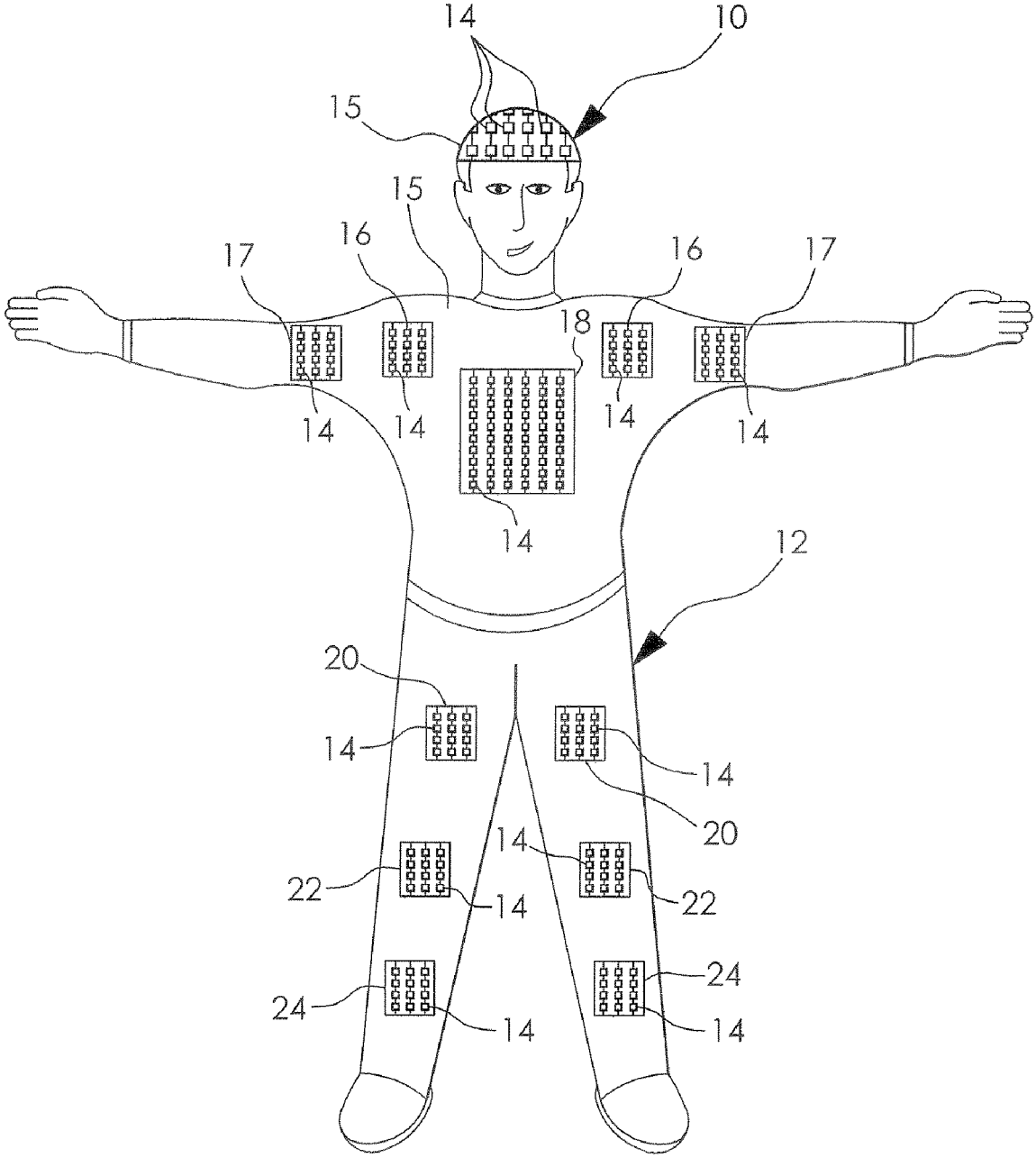
FIG. 1 shows a variety of impact-dispersing protective undergarments according to the present disclosure.

The following description is merely exemplary in nature and is not intended to limit the present disclosure, application, or uses. It should also be understood that throughout the drawings, corresponding reference numerals indicate like or corresponding parts and features. In respect of the methods disclosed, the steps presented are exemplary in nature, and thus, are not necessary or critical.

The present disclosure includes a protective, impact-dispersing undergarment 10, 12 that employs gel packets 14 to absorb and disperse an impact on an individual, for example, during an athletic activity. The undergarment 10, 12 is adapted to cover at least a portion of the individual's body. The impact-dispersing undergarment 10, 12 includes the plurality of resilient, impact-dispersing gel packets 14 selectively coupled to a wearable substrate 15 and adapted for use underneath conventional protective padding. Nonlimiting examples of undergarments 10, 12 that employ the gel may include skull caps 10, full-body undergarments 12, and other like garments adapted to be worn under conventional protective gear, such as helmets and padding. The gel may further be included in protective gear such as mouth guards and chin straps, for example. The gel disperses a force of the impact and may reduce the occurrence of contact sports injuries, e.g., concussions and contusions.

As shown FIGS. 1, 2A, 2B, and 2C, the protective, impact-dispersing undergarments 10, 12 of the disclosure may include a skull cap 10. The skull cap 10 is formed from the wearable substrate 15 such as, for example, a flexible fabric. In particular embodiments, the skull cap 10 is formed from a fine knit material, such as nylon or acrylic fabric. In additional embodiments, the skull cap 10 is formed from a material that provides sufficient ventilation and wicking of moisture from an individual during the athletic activity.

Figure 2A:
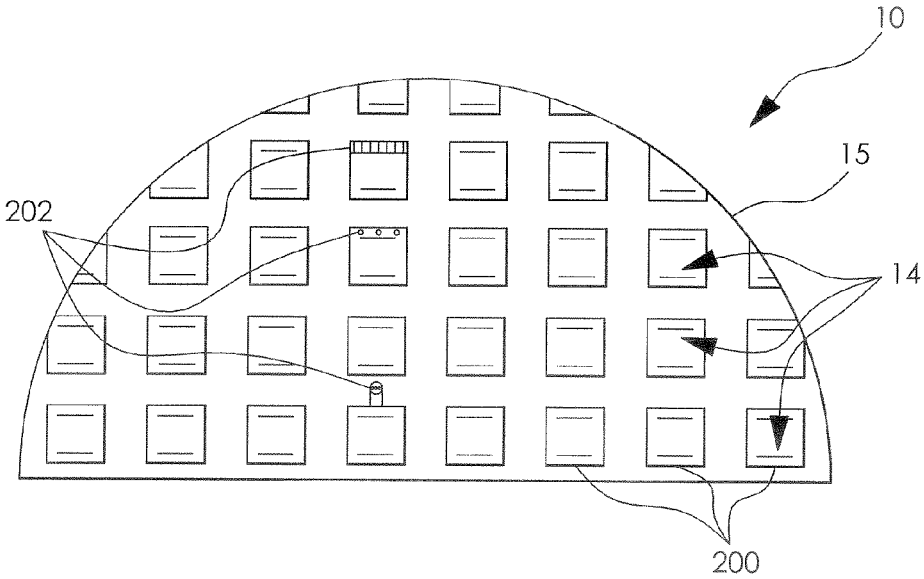
FIG. 2A shows a side view of an impact-dispersing protective skull cap according to the present disclosure.

The skull cap 10 is form-fitting and envelopes the impact-dispersing gel packets 14. As a nonlimiting example, the gel packets 14 may be securely sewn into the skull cap 10, for example, between a pair of flexible fabric sheets forming the wearable substrate 15. In a particularly illustrative embodiment, the plurality of gel packets 14 is selectively coupled to the skull cap 10. As shown in FIG. 2A, the skull cap 10 includes a plurality of pockets 200 into which individual gel packets 14 may be inserted. Thus, the skull cap 10 may be customized by an individual for a particular purpose and for use with various types of conventional protective gear. The pockets 200 may include fastening means 202 for holding the gel packets 14 in place within the pockets 200, for example, such as hook and loop fasteners, buttons, snaps and the like as shown in FIG. 2A. The pockets 200 may have a flap, for example, adapted to be held down by the fastening means 202 to close the pockets 200. The gel packets 14 may be coupled to the skull cap 10 by other suitable means known in the art, for example, adhesives. It should be understood that other means for coupling the gel packets 14 to the wearable substrate 15 may be used as desired.

Figure 2B:
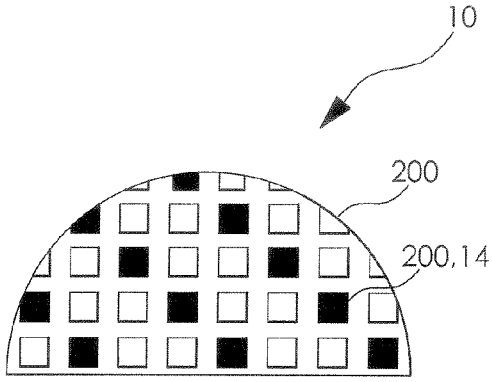
FIG. 2B shows one arrangement of the impact-dispersing gel packets in the protective skull cap depicted in FIGS. 1 and 2A.
Figure 2C:
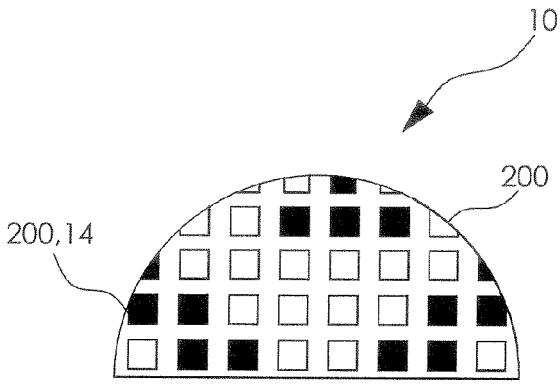
FIG. 2C shows another arrangement of the impact-dispersing gel packets in the protective skull cap depicted in FIGS. 1 and 2A.

The skull cap 10 is adapted for use with conventional protective gear such as a helmet (not shown). As particularly shown in FIGS. 2B and 2C, the gel packets 14 in the skull cap 10 may be selectively arranged in the skull cap 10 to provide a supplemental resistance to impact. The gel packets 14 may be disposed within the skull cap 10 at seams or interfaces of individual pads in the helmet, such as shown in FIG. 2B, for example. The gel packets 14 may be disposed directly underneath conventional padding, providing an additional layer of protection at desirable locations to an individual wearing the skull cap 10, such as shown in FIG. 2C, for example. Typically, the gel packets 14 are disposed in the skull cap 10 in an arrangement that is comfortable to the individual wearing the skull cap 10 with a helmet.

With renewed reference to FIG. 1, the protective, impact-dispersing undergarment 10, 12 may include the substantially full-body undergarment 12. The full-body undergarment 12 is also formed from the wearable substrate 15, including flexible materials as are known in the art. As nonlimiting examples, the full-body undergarment 12 is formed form the same materials as described herein for the skull cap 10. Other suitable materials may also be employed as desired.

The wearable substrate 15 of the full-body undergarment 12 envelopes the impact-dispersing gel packets 14. The undergarment 12 may include the plurality of gel packets 14. As described above with the skull cap 10, the gel packets 14 may be securely sewn into the full-body undergarment 12. In particular embodiments, the full-body undergarment 12 includes the plurality of pockets 200 into which individual gel packets 14 may be selectively inserted. The pockets 200 may include fastening means 202 for holding the gel packets 14 in place, such as hook and loop fasteners, buttons, snaps and the like. Thus, the skull cap 10 may be customized by an individual for a particular purpose and for use with a variety of conventional protective equipment. The gel packets 14 may be coupled to the full-body undergarment 12 by other suitable means known in the art, for example, adhesives.

The full-body undergarment 12 may provide supplemental shoulder protection 16, elbow protection 17, chest protection 18, thigh protection 20, knee protection 22, and shin protection 24. The full-body undergarment 12 may also be configured to provide other suitable forms of supplemental body protection. In providing supplemental protection, the full-body undergarment 12 is adapted to be worn underneath conventional padding, such as shoulder pads (not shown), chest pads (not shown), thigh pads (not shown), shin pads (not shown), and knee pads (not shown), for example.

As described in relation to the skull cap 10, the placement of the gel packets 14 at locations throughout the full-body undergarment 12 may be selected as desired to provide optimal supplemental protection. As nonlimiting examples, the gel packets 14 may be employed directly underneath the conventional padding to dissipate the force of an impact to said padding. As a further example, the gel packets 14 may be disposed at a seam or a gap between pads of the conventional padding.

A skilled artisan should appreciate that the full-body undergarment 12 of the invention may also be separated into individual shirts, pants, or related stockings and donned by the individual, alone or in combination, for supplemental body protection with conventional athletic padding. Thus, the present invention includes individual shirts, pants, gloves and other undergarments 10, 12 having gel packets 14 and adapted for use under conventional protective equipment.

It should be further understood that the composition of the gel in the protective undergarments 10, 12 may be selected as desired, for example, based upon the particular application. The gel may include resilient gel elastomers. Gel elastomers are highly viscoelastic polymer gels that have sufficient shock dispersion and damping characteristics. Nonlimiting examples of suitable impact-dispersing gels may include silicone gels and urethane gels. Preferred gels disperse a force of an impact in addition to absorbing at least a portion of the impact force. It should be understood that other gel compositions may also be suitable. A variety of gel compositions may also be used in a single undergarment 10, 12, providing selective impact-dispersing characteristics to desired areas of the human body.

The gel packets 14 may also include a viscoelastic outer layer or shell that provides ease in handling of the gel packets 14. The shell may be particularly desirable when the gel composition has characteristics that may otherwise result in an undesirable commingling of the gel composition and the fabric of the undergarment 10, 12 during an impact. The shell deforms without tearing upon impact and regains an original shape following removal of the impact force The dimensions of individual gel packets 14 may also be selected as desired. As a nonlimiting example, individual gel packets 14 may have a thickness of up to about ½". Other thicknesses may also be employed as appropriate. For example, the thickness of the individual gel packets 14 may be selected to lessen the effect of the impact upon the individual and provide comfort to the individual wearing the protective, impact-dispersing undergarment 10, 12. The width, length, and overall shape of individual gel packets 14 may also vary as desired.

The present invention further includes a method for reducing an impact on an individual, particularly during a contact activity. The method first includes the steps of providing an impact-dispersing undergarment 10, 12 as disclosed herein, and providing at least one piece of protective equipment. Next, the process includes disposing the impact-dispersing undergarment 10, 12 on the individual. The protective equipment is then placed over the impact-dispersing undergarment 10, 12. The impact-dispersing undergarment 10, 12 militates against injury to the individual resulting from an impact during activity.

The method of the present invention may further include selecting a placement of the gel packets 14 within the impact-dispersing undergarments 10, 12 based on the type and design of the conventional protective gear being used by the individual. The gel packets 14 may therefore be placed in locations that optimize and supplement the padding protection provided by the conventional protective gear. It should be appreciated that this method allows the individual to customize the individual's impact protection, regardless of the configuration and design of the conventional protective gear employed.

The present invention is particularly suitable for use in contact sports, for example, professional, college, high school, and middle school sports such as football, hockey, and the like. The undergarments 10, 12 of the invention may also be suitable for use in other contact sports and athletic activities. It should be further appreciated that this invention may also be suitable or military use, for example, underneath protective military gear and armor.

While certain representative embodiments and details have been shown for purposes of illustrating the invention, it will be apparent to those skilled in the art that various changes may be made without departing from the scope of the disclosure, which is further described in the following appended claims.

What is claimed is:

1. A method for protecting an individual, comprising the steps of:

providing a helmet having padding for protecting the head of the individual;

providing an impact-dispersing skull cap including a single layer of flexible fabric formed from a fine knit material and shaped to form fit to a head of the individual, the skull cap having at least one pocket adapted to receive at least one resilient, impact-dispersing gel packet, the gel packet securely sewn within the pocket, the resilient, impact-dispersing gel packet consisting essentially of a resilient gel elastomer disposed within a viscoelastic outer shell, the viscoelastic outer shell militating against a commingling of the resilient gel elastomer with the flexible fabric, the at least one gel packet selectively arranged in the at least one pocket of the skull cap to provide supplemental protection underneath the helmet;

disposing the impact-dispersing skull cap on the head of the individual; and placing the helmet over the impact-dispersing skull cap, wherein the protection afforded by the helmet is supplemented;

wherein the viscoelastic outer shell of the at least one gel packet deforms without tearing upon an impact to the head of the individual and regains an original shape following removal of an impact force, wherein the impact-dispersing skull cap militates against a concussion to the individual resulting from the impact force on the individual wearing the impact-dispersing skull cap and the helmet.

2. The method of claim 1, wherein the helmet is one of a football helmet, a hockey helmet, and a military helmet.

* * * * *